US005881801A

United States Patent [19]

Hayakawa et al.

[11] Patent Number: 5,881,801

[45] Date of Patent: Mar. 16, 1999

[54] THERMALLY DRIVEN LIQUID PRESSURE GENERATING APPARATUS

[75] Inventors: Yukio Hayakawa; Kiyoshi Nakahara, both of Tochigi-ken, Japan

[73] Assignee: Honda Giken Kogyo Kabushiki Kaisha, Tokyo, Japan

[21] Appl. No.: 84,781

[22] Filed: May 27, 1998

[30] Foreign Application Priority Data

May 29, 1997 [JP] Japan ..... 139769/1997

[51] Int. Cl.[6] ..... F28D 15/00

[52] U.S. Cl. ..... 165/104.24; 165/272; 165/104.27; 60/531

[58] Field of Search ..... 165/104.27, 104.24, 165/104.21, 104.14; 60/531, 618, 396

[56] References Cited

U.S. PATENT DOCUMENTS

| | | | |
|---|---|---|---|
| 2,976,675 | 3/1961 | Bonner | 60/531 |
| 5,353,596 | 10/1994 | Siegel | 60/531 |

FOREIGN PATENT DOCUMENTS

| | | | |
|---|---|---|---|
| 657023 | 1/1935 | Germany | 60/531 |
| 2753660 | 6/1979 | Germany | 60/531 |
| 3232497 | 2/1983 | Germany | 60/531 |

*Primary Examiner*—Ira S. Lazarus
*Assistant Examiner*—Christopher Atkinson
*Attorney, Agent, or Firm*—Armstrong, Westerman, Hattori, McLeland & Naughton

[57] ABSTRACT

A vessel of a liquid pressure generating apparatus is divided into two vessels of an upper liquid pressure generating vessel containing therein a liquid chamber whose volume can be varied, and a lower medium vessel into which is filled a medium which varies between a gaseous state and a liquid state. Both the vessels are connected by a communicating passage. The two vessels are respectively provided with heating heat exchange portions into which is inputted an external heat such as a waste heat of a driving source of a vehicle. The medium vessel is also provided with a cooling heat exchange portion. By the inputting of heat and stopping thereof, the liquid pressure can be controlled with good response.

3 Claims, 2 Drawing Sheets

THERMALLY DRIVEN LIQUID PRESSURE GENERATING APPARATUS

BACKGROUND OF THE INVENTION

1. Field of the Invention

The present invention relates to a thermally driven (or thermally operated) liquid pressure generating apparatus which is suitable as a liquid pressure source for a fluid actuator which is mounted on a vehicle such as a motor vehicle.

2. Description of the Related Art

In case a fluid actuator such as a hydraulic cylinder for adjusting a vehicle height, a hydraulic cylinder for steering rear wheels in a four-wheel-steering vehicle, or the like, is mounted on a vehicle, there has conventionally been used, as a liquid pressure source for the fluid actuator, a pump which is driven by an electric motor or an engine. This arrangement, however, has a disadvantage in that the energy consumption increases and the specific fuel consumption becomes poor.

Therefore, as a liquid pressure source which serves as an alternative for the pump, it is desired to use a thermally driven liquid pressure source which generates the liquid pressure by utilizing a waste heat of the driving source which is mounted on the vehicle.

As this kind of liquid pressure generating apparatus, the following is considered. Namely, a medium which changes the phase between a gaseous phase and a liquid phase is filled in a vessel containing therein a liquid chamber which is capable of changing its own volume. At the bottom of the vessel, there is provided a heat exchange portion to which is inputted an external heat, i.e., the waste heat from the driving source. The liquid-phase medium which stays at the bottom of the vessel is heated to change its phase to a gaseous phase. The liquid chamber is thus compressed by the vapor pressure of the medium to thereby generate the liquid pressure.

The above-described thermally driven liquid pressure generating apparatus has the following disadvantages. Namely, since the internal volume of the vessel in other than the liquid chamber increases as a result of compression of the liquid chamber, the vapor of the medium adiabatically expands to thereby lower in temperature, with the result that the vapor pressure lowers or decreases and further that the medium condenses. It thus takes time to increase or boost the liquid pressure. Further, even if the heat input to the heat exchange portion has been stopped, the vapor pressure does not lower or decrease much until the entire vessel has cooled down, with the result that the decrease in the liquid pressure also takes time.

In view of the above-described disadvantages, the present invention has an object of providing a thermally driven liquid pressure generating apparatus in which the liquid pressure can be increased or decreased with a good response.

SUMMARY OF THE INVENTION

In order to attain the above and other objects, the present invention is a thermally driven liquid pressure generating apparatus comprising a liquid chamber whose volume is variable, wherein a medium which varies between a gaseous state and a liquid state is evaporated by an external heat to compress the liquid chamber by a vapor pressure of the medium to thereby generate a liquid pressure, characterized in that a vessel of the liquid pressure generating apparatus is divided into two vessels of a liquid pressure generating vessel containing therein the liquid chamber and a medium vessel disposed below the liquid pressure generating vessel such that the vapor of the medium evaporated in said medium vessel is introduced into the liquid pressure generating vessel via a communicating passage, and that a heating heat exchange portion for inputting heat from outside is provided in the medium vessel and in the liquid pressure generating vessel, respectively.

According to the present invention, even if the internal volume in other than the liquid chamber of the liquid pressure generating vessel is increased as a result of the compression of the liquid chamber, the temperature drop in the vapor of the medium is restricted by the heat input from the heating heat exchange portion of the liquid pressure generating vessel. Therefore, the liquid pressure can be boosted with a good response.

Further, if the temperature in the medium vessel lowers even when the temperature of the liquid pressure generating vessel is high, the vapor of the medium returns back to the medium vessel due to the temperature difference. As a result, the vapor pressure inside the liquid pressure generating vessel decreases with a consequent decrease in the liquid pressure. In this manner, since the liquid pressure can be lowered only by cooling the medium vessel, the heat mass to be cooled at the time of pressure decrease becomes small, and the pressure decrease in the liquid pressure can be made with a good response.

Preferably, the thermally driven liquid pressure generating apparatus further comprises a control means for controlling the input of heat into the heating heat exchange portion which is provided in the medium vessel, the controlling being made independent of the input of heat into the heating heat exchange portion which is provided in the liquid pressure generating vessel. By making this arrangement, it is possible to constantly keep the heat input to the heating heat exchange portion of the liquid pressure generating vessel, and to input the heat into the heating heat exchange portion of the medium vessel only when the liquid pressure is boosted. According to this arrangement, since the liquid pressure generating vessel has been heated in advance at the time of boosting, the response of boosting the pressure is further improved.

In addition, preferably the thermally driven liquid pressure generating apparatus further comprises a cooling heat exchange portion which is provided in the medium vessel. According to this arrangement, when the liquid pressure is lowered by stopping the heat input into the heating heat exchanging portion of the medium vessel, the medium vessel can be rapidly cooled by the cooling heat exchange portion. The response for pressure decrease can thus be further improved.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 1:
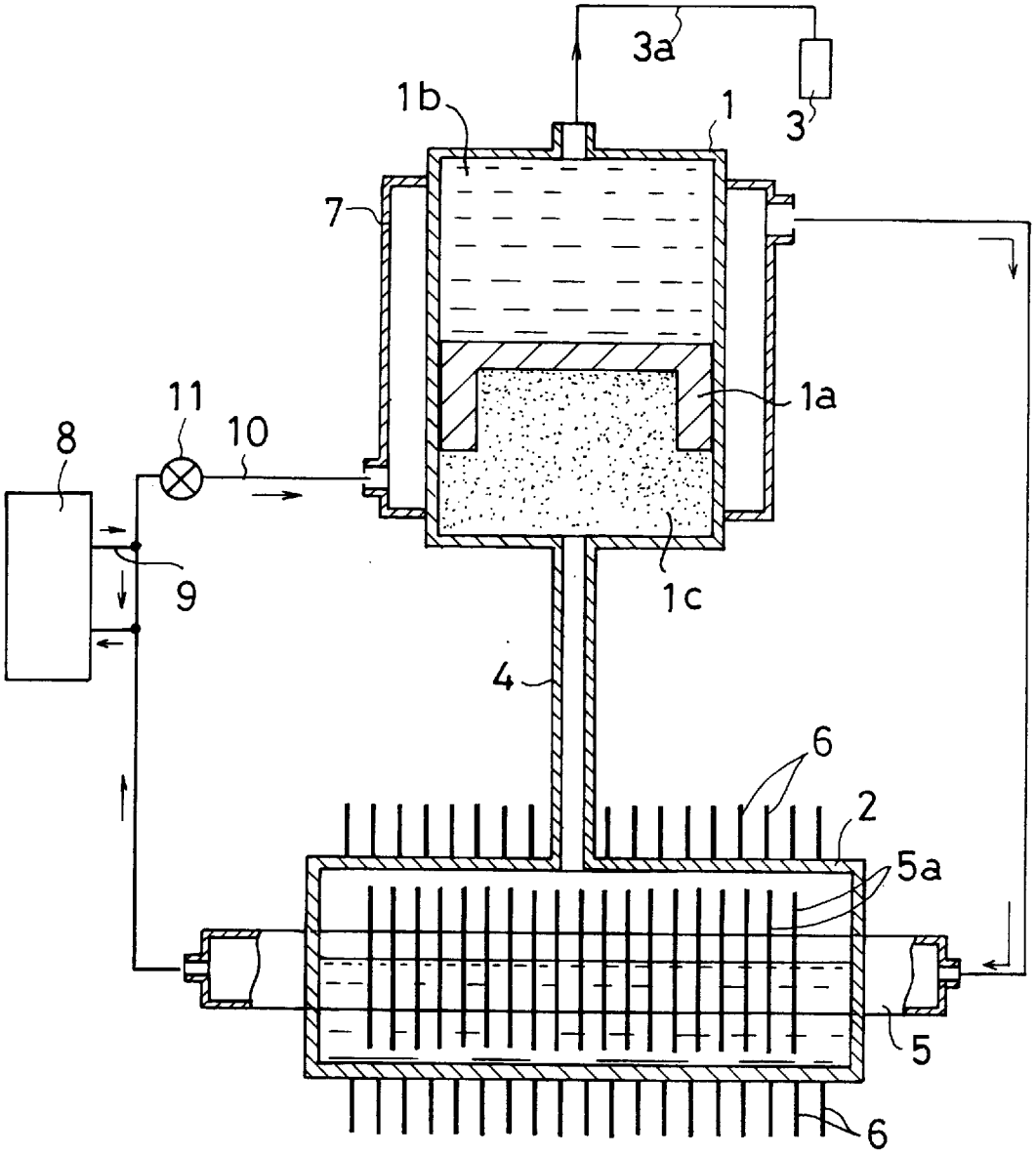
FIG. 1 is a schematic diagram showing a first embodiment of a thermally driven liquid pressure generating apparatus according to the present invention.

FIG. 1 shows a thermally driven liquid pressure generating apparatus which is mounted on a vehicle.

This apparatus is provided with a vessel for generating therein a liquid pressure (hereinafter called "a liquid pressure generating vessel") 1 and a vessel for containing therein a medium (hereinafter called "a medium vessel") 2.

The liquid pressure generating vessel 1 is formed into a cylindrical shape which is elongated in a vertical direction. A piston la is inserted into the liquid pressure generating vessel 1 in a vertically movable manner. That chamber inside the liquid pressure generating vessel 1 which lies above the piston 1*a* (hereinafter called "an above-piston chamber") is constituted into a liquid chamber 1*b* which is connected, via a piping material 3*a*, to a fluid actuator 3 such as a hydraulic cylinder for adjusting the vehicle height.

The medium vessel 2 is in fluid flow communication with that chamber 1*c* inside the liquid pressure generating vessel 1 which lies below the piston 1*a* (hereinafter called "a below-piston chamber"). The medium vessel 2 is filled with a medium of low boiling point such as ammonia, substitute Freon (e.g., Freon 134*a*), or the like. It is thus so arranged that the vapor of the medium evaporated inside the medium vessel 2 is introduced into the below-piston chamber 1*c* via a communicating passage 4.

The medium vessel 2 is provided with a heat exchange portion 5 for heating purpose (hereinafter called "a heating heat exchange portion 5") which is made up of a tube having a large number of fins 5*a*. Further, on an outer surface of the medium vessel 2, there is provided a heat exchange portion 6 for cooling purpose (hereinafter called "a cooling heat exchange portion 6") which is made up of a large number of fins. Though not illustrated, cooling wind such as the wind which flows along the vehicle while it is running is introduced into this cooling heat exchange portion 6 via a duct which is provided with a shutter.

The liquid pressure generating vessel 1 is provided with a heat exchange portion 7 for heating purpose (hereinafter called "a heating heat exchange portion 7") which is made up of a jacket which encloses the circumferential wall of the liquid pressure generating vessel 1. To a circulation circuit 9 for circulating a cooling medium such as water, oil, or the like, for cooling a power source 8 which is made up of an engine, or an electric motor of an electric vehicle, there is connected, via a solenoid valve 11, a bypass circuit 10 in which the heating heat exchanging portion 7 of the liquid pressure generating vessel 1 and the heating heat exchange portion 5 are interposed in series.

According to the above-described arrangement, when the solenoid valve 11 is opened, the cooling medium flows into both the above-described heating heat exchanging portions 7, 5, whereby the waste heat of the driving source 8 is inputted into both the above-described heating heat exchanging portions 7, 5. Due to the heat input from the heating heat exchanging portion 5, the medium inside the medium vessel 2 is evaporated through heating. The vapor of the medium thus flows into the below-piston chamber 1*c* of the liquid pressure generating vessel 1. As a result, the piston 1*a* is pushed up by the vapor pressure, whereby the liquid chamber 1*b* is compressed and the liquid pressure to be supplied to the fluid actuator 3 rises.

In this case, the volume of the below-piston chamber 1*c* increases as a result of the upward movement of the piston 1*a*. However, since the area of heat transfer of the below-piston chamber 1*c* relative to the heating heat exchange portion 7 increases, the amount of heat input from the heating heat exchanging portion 7 to the below-piston chamber 1*c* also increases as a result of the upward movement of the piston 1*a*. Therefore, the decrease in temperature of the vapor of the medium due to the expansion of the below-piston chamber 1*c* is restricted, with the result that the liquid pressure is boosted with a good response.

In order to lower the liquid pressure, the solenoid valve 11 is closed to shut out the inputting of the waste heat into both the heating heat exchanging portions 7, 5. Also, the cooling wind is introduced into the cooling heat exchange portion 6 to cool the medium vessel 2. According to these operations, due to the temperature difference between the liquid pressure generating vessel 1 and the medium vessel 2, the vapor of the medium returns to the medium vessel 2. The vapor pressure in the below-piston chamber 1*c* lowers before the liquid pressure generating vessel 1 is cooled. As a result, the liquid pressure can be lowered with a good response.

In the above-described embodiment, the heating heat exchange portion 7 of the liquid pressure generating vessel 1 and the heating heat exchange portion 5 of the medium vessel 2 are interposed in series in the bypass circuit 10 which is connected to the cooling medium circulation circuit 9 via the solenoid valve 11. The following arrangement may also be employed. Namely, as in the embodiment shown in FIG. 2, the heating heat exchange portion 7 of the liquid pressure generating vessel 1 is interposed in the cooling medium circulation circuit 9. In the bypass circuit 10 there is interposed only the heating heat exchange portion 5 of the medium vessel 5. The inputting of the waste heat into the heating heat exchange portion 5 is arranged to be controllable by the opening and closing of the solenoid valve 11, independent of the inputting of the waste heat into the heating heat exchanging portion 7.

Figure 2:
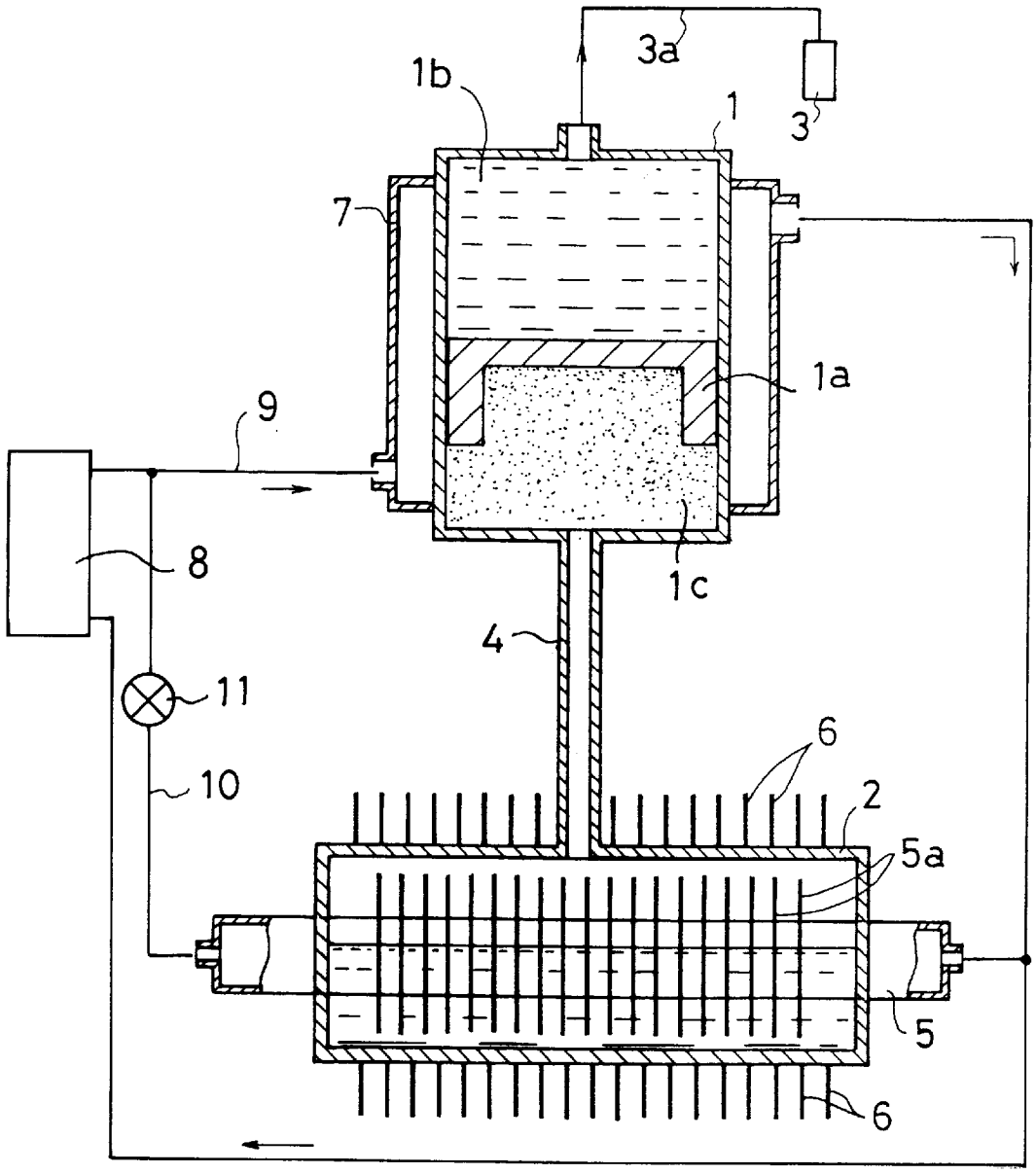
FIG. 2 is a schematic diagram showing a second embodiment of a thermally driven liquid pressure generating apparatus according to the present invention.

In the embodiment shown in FIG. 2, the liquid pressure generating vessel 1 is constantly kept heated. Therefore, by only inputting the waste heat into the heating heat exchange portion 5 by opening the solenoid valve 11, the liquid pressure can be boosted with a good response without causing a thermal loss in the liquid pressure generating vessel 1.

In the above-described embodiments, the liquid pressure generating vessel 1 and the medium vessel 2 are disposed in a vertically separated relationship. It is however possible to dispose both the vessels 1, 2 in a vertically contacting relationship with each other. In this case, it is preferable to interpose a thermally separating or insulating material in a space of contact between both the vessels 1, 2 in order to thermally insulate both the vessels 1, 2.

Explanations have so far been made about the liquid pressure generating apparatus for a vehicle in which apparatus the waste heat of the driving source 8 is utilized. The present invention can also be applied to a liquid pressure generating apparatus for a vehicle in which apparatus other heat such as solar heat, or the like, is utilized, as well as to a liquid pressure generating apparatus for purposes other than for a vehicle.

As can be seen from the above-described explanations, according to the present invention, the liquid pressure can be boosted or lowered with good response by the inputting and stopping of heat. Therefore, the control of the liquid pressure becomes easy.

It is readily apparent that the above-described thermally driven liquid pressure generating apparatus meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A thermally driven liquid pressure generating apparatus comprising a liquid chamber whose volume is variable, wherein a medium which varies between a gaseous state and a liquid state is evaporated by an external heat to compress said liquid chamber by a vapor pressure of the medium to thereby generate a liquid pressure, characterized in that a vessel of said liquid pressure generating apparatus is divided into two vessels of a liquid pressure generating vessel containing therein said liquid chamber and a medium vessel disposed below said liquid pressure generating vessel such that the vapor of the medium evaporated in said medium vessel is introduced into said liquid pressure generating vessel via a communicating passage, and that a heating heat exchange portion for inputting heat from outside is provided in said medium vessel and around said liquid pressure generating vessel, respectively.

2. A thermally driven liquid pressure generating apparatus according to claim 1, further comprising a control means for controlling the input of heat into said heating heat exchange portion which is provided in said medium vessel, said controlling being made independent of the input of heat into said heating heat exchange portion which is provided in said liquid pressure generating vessel.

3. A thermally driven liquid pressure generating apparatus according to claim 1, further comprising a cooling heat exchange portion which is provided in said medium vessel.

* * * * *